United States Patent [19]

Iwai et al.

[11] 4,456,798

[45] Jun. 26, 1984

[54] PANEL KEYBOARD WITH IRREGULAR SURFACED SPACER

[75] Inventors: Shoichiro Iwai; Eiichi Kameda, both of Inashiki, Japan

[73] Assignee: Nippon Mektron Ltd., Japan

[21] Appl. No.: 271,042

[22] Filed: Jun. 5, 1981

[30] Foreign Application Priority Data

Sep. 18, 1980 [JP] Japan ..... 55-129673

[51] Int. Cl.[3] ..... H01H 13/70

[52] U.S. Cl. ..... 200/5 A; 200/86 R; 200/159 B; 200/306

[58] Field of Search ..... 200/5 R, 5 A, 159 B, 200/86 R, 306

[56] References Cited

U.S. PATENT DOCUMENTS 3,600,528 8/1971 Leposavic ..... 200/159 B X
3,745,287 7/1973 Walker ..... 200/159 B
3,920,940 11/1975 Brown et al. ..... 200/86 R X
4,066,851 1/1978 White et al. ..... 200/306 X

FOREIGN PATENT DOCUMENTS 2829891 2/1979 Fed. Rep. of Germany ... 200/159 B
2389218 12/1978 France ..... 200/159 B

*Primary Examiner*—J. R. Scott
*Attorney, Agent, or Firm*—David S. Fishman

[57] ABSTRACT

A switch array is defined by a pair of printed circuits separated by a nonconductive spacer which is provided with apertures which form cavities into which switch contacts on the circuits may be forced to produce switch closures. The spacer is contoured to define gas flow channels which communicate with the cavities whereby switch operation will not be impeded by gas trapped in the cavities.

6 Claims, 9 Drawing Figures

PANEL KEYBOARD WITH IRREGULAR SURFACED SPACER

BACKGROUND OF THE INVENTION (1) Field of the Invention

The present invention is directed to improved membrane switch assemblies. Specifically, this invention relates to a membrane switch assembly having internal cavities which are vented to the ambient atmosphere through a porous or air permeable structure.

(2) Description of the Prior Art

Prior art membrane switch assemblies of the type employed in miniaturized keyboards have customarily been constructed by laminating an apertured spacer sheet between two substrates which support printed circuits. The substrates, at least one of which will be flexible, are positioned so that circuit patterns thereon face each other. The switches are defined by locating the spacer sheet apertures so that, with the application of pressure to one of the substrates, appropriate portions of the printed circuits can be made to contact each other. These prior art membrane switch assemblies were usually constructed so that the switch cavities or chambers formed by the apertures within the spacer sheet were permanently sealed from the surrounding environment. These cavities were filled with a gas, typically air.

The above-discussed prior art method of constructing membrane switch assemblies has certain disadvantages. A major disadvantage which results from hermetically sealing the cavities defined by the spacer sheet apertures occurs when there is a change in the external fluid pressure, the atmospheric pressure for example. If a machine which incorporates the membrane switch assembly is located at an altitude where the outside atmospheric pressure is less than the pressure within the sealed cavities, the greater internal pressure exerts an outward force upon the layers of the switch laminate. The result of this outward expansion is that there is a cushioning effect to the operation of the individual keys. With a sufficiently large pressure differential, it becomes difficult for the operator to determine whether the key has been activated. In the extreme situation, when the difference between the outside atmospheric pressure and the pressure within the cavities is quite large, the membrane switch assembly may become distorted with structural damage possibly being caused by the increasing pressure on the laminate walls caused by the outward expansion.

A similar result occurs when the outside atmospheric pressure becomes greater than the pressure within the cavities. This will occur, for example, when the mechanism incorporating the membrane switch assembly is operated in an environment where the ambient pressure is greater than that where the laminate was constructed. The result would be that the force exerted upon the wall of the laminate by the outside atmospheric pressure would move the walls of the laminate inwardly. The usual effect of this pressure differential would not be as significant as when the atmospheric pressure is less than the internal pressure. However, in the extreme condition when the pressure differential between the outside atmospheric pressure and the internal pressure becomes great, the switch might be activated.

It is to be observed that, even under normal operating conditions, the gas which is in the cavities resists compression of the walls of the laminate when a user tries to activate the keys. This results in a cushioning effect which is felt by the user of prior art membrane switch assemblies. While under certain circumstances a cushioning effect may be desirable, it may also reduce the users ability to activate a switch, by depressing a key for example, or detect whether a switch has been actuated.

Several methods have been proposed and/or utilized to try to alleviate the above-discussed disadvantages of prior art membrane switch assemblies. One proposed prior art method involves incorporating internal channels within the laminate between the cavities. This allows displacement of the fluid medium between the internal cavities of the membrane switch assembly. When one switch is activated the fluid within the spacer sheet defined cavity associated with that switch is displaced by the downward force of the membrane wall and will flow through the channels into one or more other cavities. While this will help to minimize the cushioning effect caused by the resistance of the internal pressure to the downward depression of the membrane wall, it will not alleviate the problems associated with an internal/external pressure differential.

It has also been proposed to equalize the internal pressure with the external pressure by establishing fluid communication between the ambient atmosphere and the interior of the switch assembly by providing a hole in the outer layers of the membrane switch assembly; commonly referred to as a through-hole. This through-hole in the laminate of the switch assembly allows air to flow freely into and out of the assembly's cavities. While this technique would solve the problems associated with the pressure differential between the external-/internal pressures, it creates some of its own disadvantages. The major of these disadvantages becomes apparent with the incorporation of the completed membrane switch assembly into a final product. The through-hole vents would typically be provided through the entire switch assembly. Although holes in the front surface of the assembly may be sealed off, for example by indicia bearing sheets, the holes at the back surface must remain clear. This causes difficulties when installing the switch laminate into products such as calculators, microwave ovens, thermostatic controls, etc. The membrane switch assembly would, to keep the through-hole open, have to be either spatially separated from the surrounding housing or the surrounding housing would have to be provided with corresponding holes to allow for a free flow of air into and out of the through-holes. This requires additional manufacturing steps or a larger housing to provide the spatial separation. Furthermore, since many membrane switch assemblies are secured within the final product through uses of adhesives, during manufacturing, special care would be required to avoid having the adhesive flow into or seal off the through-hole vents. Finally, free flow between the ambient atmosphere and the interior of the switch assembly enhances the possibility of dirt or other contaminants reaching the switch contacts and causing faulty operation.

SUMMARY OF THE INVENTION

The present invention overcomes the above-discussed disadvantages and other deficiencies of the prior art by providing a novel and improved membrane switch assembly.

In accordance with the present invention, a switch assembly is constructed along conventional lines with two planar nonconductive substrates provided with conductor patterns that are located so as to face each other. A nonconductive spacing sheet is positioned between and bonded to the two substrates. This spacer sheet is provided with apertures which define switch cavities. Electrical contact is established between appropriate portions of the two conductor patterns by inwardly deflecting in the region of the spacer sheet apertures, of one or both substrates.

The improvement over the prior art involves providing the spacing layer with at least one irregular surface so as to allow air to flow out of and into the individual switch cavities upon switch closure and opening, switch closure reducing the volume of a switch cavity. The spacing sheet may be comprised of any suitable insulating material with the surface pattern or contour being provided by initially molding the material or subsequently sandblasting, electric discharge machining, or performing another process to provide the desired surface. The spacer may also be reticular, wherein a net like sheet is formed from nonconductive fibers, or of lattice or honeycomb construction.

DESCRIPTION OF THE DRAWINGS

The present invention may be better understood and its numerous objects and advantages will become apparent to those skilled in the art by reference to the accompanying drawing wherein like reference numerals refer to like elements in the several FIGURES and wherein.

DESCRIPTION OF THE PREFERRED EMBODIMENT

The present invention is directed to switch assemblies for electronic equipment. These switch assemblies are provided with two nonconductive substrates or printed circuit boards, at least one of which is flexible, which carry conductive circuit patterns. These circuit patterns are arranged so as to face one another. In order to prevent electrical contact between these conductive circuit patterns, and thereby define an array of normally open switches, a sheet of nonconductive material is placed between the two substrates. This nonconductive spacing sheet is provided with apertures at desired locations, so that the circuit patterns on the two substrates can be placed into electrical contact with each other by deflecting one or both nonconductive substrates towards each other through the hole provided in the spacing sheet. Two such prior art switch assemblies are represented in FIGS. 1 and 2.

Figure 1:
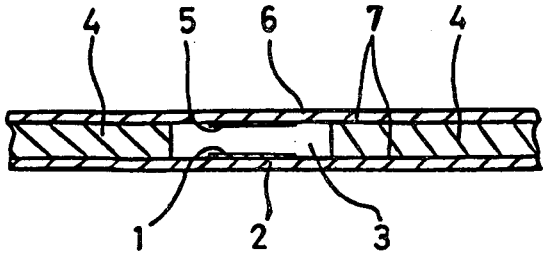
FIG. 1 PRIOR ART
FIG. 1 is a partial cross-sectional view of a prior art membrane type switch assembly.

In FIG. 1 the nonconductive substrates, indicated at 2 and 6, carry respective conductive patterns 1 and 5, which are positioned so as to face each other. The substrates 2 and 6 are separated by spacing sheet 4. While both layers 2 and 6 may be comprised of a flexible polymeric material, it is sometimes preferable to form one of the layers from a rigid polymeric or similar material so that it may function as a support base. The spacer sheet 4 is provided, at desired locations, with apertures which define switch cavities such as indicated at 3. By compressing layer 6 towards layer 2 electrical contact may be established between conductive patterns 5 and 1. This switch assembly is hermetically sealed by a nonconductive adhesive 7 which is applied between the substrates 6 and 2 and spacing sheet 4.

Figure 2:
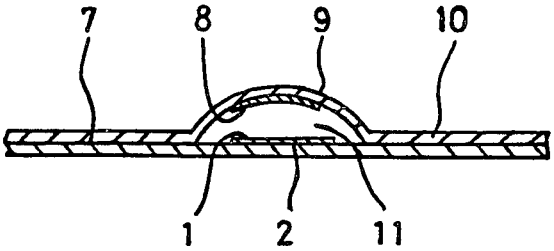
FIG. 2 PRIOR ART
FIG. 2 is a partial cross-sectional view of another prior art membrane switch assembly.

Referring to FIG. 2, another prior art switch assembly is represented. The assembly of FIG. 2 is similar to the assembly of FIG. 1 except for the lack of a spacing sheet. In the FIG. 2 assembly the two nonconductive substrates 2 and 10 carry conductor patterns 8 and 1. Layer 10 is further provided with a dome-shaped portion 9 which is capable of being distorted so as to establish electrical contact between the circuit patterns 8 and 1. The distortion of dome-shaped portion 9 is known as a click or snap-through center operation. The layers 2 and 10 are hermetically sealed to one another by a nonconductive adhesive 7. This results in the area 11 under dome 9 being a sealed switch cavity.

As stated above prior art switch assemblies of the type represented in FIGS. 1 and 2 are typically hermetically sealed in order to prevent environmental deterioration of the circuit patterns. This hermetic sealing of the switch assembly entraps air within the switch cavities, 3 and 11. Operation of the switches is inhibited by this incompressible trapped air. Additional disadvantages of these prior art sealed switch assemblies have already been discussed above.

Figure 3:
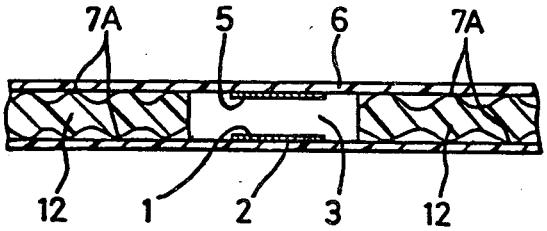
FIG. 3 is a partial cross-sectional view of a switch assembly in accordance with one embodiment of the present invention.
Figure 4:
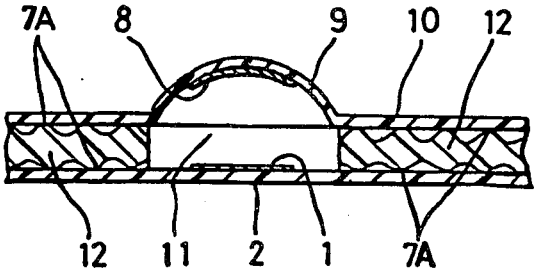
FIG. 4 is a partial cross-sectional view of a switch assembly in accordance with another embodiment of the present invention.

Referring jointly to FIGS. 3 and 4, two embodiments of a switch assembly in accordance with the present invention are represented. The switch assemblies of FIGS. 3 and 4 respectively have the same general configuration as the devices of FIGS. 1 and 2 and thus the same reference numerals have been employed. The improvement embodied in the switch assemblies of FIGS. 3 and 4, when compared to the devices of FIGS. 1 and 2 resides in the improved spacer sheet 12 which is positioned between the respective circuit carrying sheets, 2 and 6 and 2 and 10. This spacer sheet 12, in the manner to be described below, allows the flow of air into and out of the switch cavities 3 and 11 which are defined by apertures provided in spacer sheet 12.

Figure 5A:
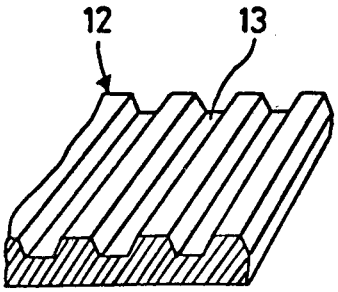
FIGS. 5A–E are partial perspective views of various spacer sheets which may be employed in the practice of the present invention.
Figure 5B:
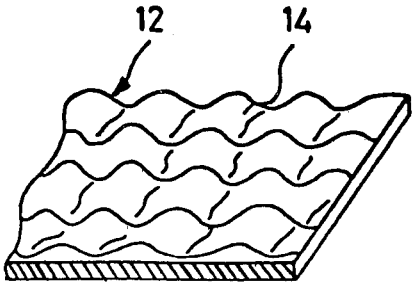
Figure 5C:
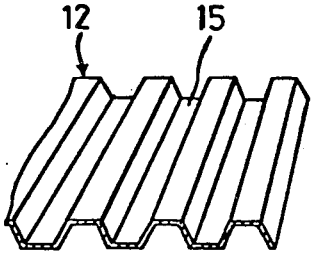
Figure 5D:
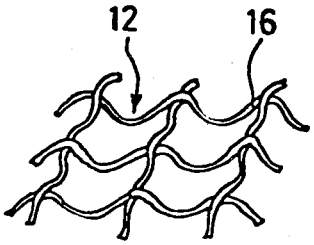
Figure 5E:
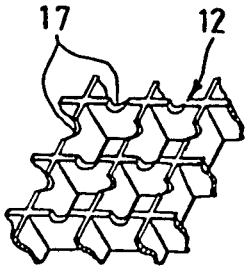

Referring to FIGS. 5A–E, various embodiments of the spacer sheet 12 of FIGS. 3 and 4 are seen. The spacer sheet 12 must be comprised of a nonconductive material in order to prevent establishing electrical contact between the conductor patterns on the respective substrates 2, 6 and 10. As depicted in FIG. 5A spacer sheet 12 may be provided with protrusions which define undulations or corrugations 13 at least upon one side of sheet 12. It should be noted that these protrusions may also be formed upon both sides of sheet 12 and may extend in different directions on the two sides. In FIG. 5B the spacer sheet 12 is provided with hills and valleys also along at least one surface. In FIG. 5C spacer sheet 12 is formed from a relatively thin member so as to have a wave-like shape which define grooves 15 on both sides. FIG. 5D depicts a reticular sheet 16 formed by interconnecting strands or lengths of a nonconductive material, with the strands being bent or formed in an oscillating pattern. Finally, FIG. 5E is a honeycomb or checkerboard form comprised of a nonconductive material having notches 17 provided on the tops of the ribs at least at one surface. The apertures 3 and 11 which define the switch cavities will, of course, be formed in the spacer sheets of FIGS. 5A–5E, these apertures being shown in FIGS. 3 and 4.

While preferred embodiments have been described and illustrated, various substitutions and modifications may be made thereto without departing from the spirit and scope of the invention. Accordingly, it is to be understood that the present invention has been described by way of illustration and not limitation.

What is claimed is:

1. A switch assembly comprising:

first circuit means, said first circuit means comprising a flexible planar nonconductive substrate having a conductive circuit pattern supported on at least a first surface thereof;

second circuit means, said second circuit means including a nonconductive substrate having a conductive circuit pattern supported on at least a first surface thereof, said circuit pattern of said second circuit means facing said circuit pattern of said first circuit means and being at least partly in registration therewith;

nonconductive spacer means, said spacer means being disposed between said first and said second circuit means, said spacer means including at least a first aperture extending therethrough, said aperture being aligned with registered circuit portions on said circuit means whereby electrical contact between registered portions of said circuit pattern of said first circuit means and said circuit pattern of said second circuit means may be established through said spacer means aperture, said aperture cooperating with said circuit means to define a cavity between said first and said second circuit means, said spacer means having at least a first undulating surface adjacent to one of said circuit means, said undulating surface defining a gas flow passage which is in communication with said cavity defined by said aperture.

2. The assembly of claim 1 wherein said spacer means is comprised of a solid material having protrusions forming said undulating surface.

3. The assembly of claim 1 wherein said spacer means is comprised of a solid material have a reticular shape.

4. The assembly of claim 1 wherein said spacer means is comprised of a formed sheet material which defines longitudinal grooves on two opposed surfaces of said spacer means.

5. The assembly of claim 1 wherein said spacer means has a plurality of switch cavity defining apertures and wherein said gas flow passages establish fluid communication between plural of said apertures.

6. The assembly of claim 5 wherein said spacer means has a second undulating surface adjacent to the other of said circuit means.

* * * * *